US010615531B2

(12) United States Patent
Hayama

(10) Patent No.: US 10,615,531 B2
(45) Date of Patent: Apr. 7, 2020

(54) SOCKET HAVING CONDUCTIVE TERMINALS FOR CONNECTORS

(71) Applicant: Furutech Co., Ltd., Tokyo (JP)

(72) Inventor: Frank Hayama, Tokyo (JP)

(73) Assignee: FURUTECH CO., LTD., Tokyo (JP)

( * ) Notice: Subject to any disclaimer, the term of this patent is extended or adjusted under 35 U.S.C. 154(b) by 0 days.

(21) Appl. No.: 14/962,787

(22) Filed: Dec. 8, 2015

(65) Prior Publication Data

US 2016/0172798 A1 Jun. 16, 2016

(30) Foreign Application Priority Data

Dec. 10, 2014 (TW) ..... 103221884 U

(51) Int. Cl.

| | |
|---|---|
| ***H01R 13/42*** | (2006.01) |
| ***H01R 24/78*** | (2011.01) |
| *H01R 103/00* | (2006.01) |
| *H01R 13/03* | (2006.01) |

(52) U.S. Cl.

CPC ..... *H01R 13/42* (2013.01); *H01R 24/78* (2013.01); *H01R 13/03* (2013.01); *H01R 2103/00* (2013.01)

(58) Field of Classification Search

CPC ..... H01R 43/0207; H01R 13/42

USPC ..... 439/737, 733.1, 810

See application file for complete search history.

(56) References Cited

U.S. PATENT DOCUMENTS

| | | | | |
|---|---|---|---|---|
| 1,941,612 A * | 1/1934 | Massey | H01R 27/00 | 439/737 |
| 2,145,164 A * | 1/1939 | Douglas | H01R 13/20 | 439/569 |
| 2,337,735 A * | 12/1943 | Brus | H01R 24/28 | 439/598 |
| 3,160,460 A * | 12/1964 | Wyzenbeek | H01R 23/10 | 174/152 R |
| 3,499,831 A * | 3/1970 | Bullough | C25C 3/16 | 174/126.2 |
| 3,500,297 A * | 3/1970 | Bac | H01R 13/426 | 439/733.1 |
| 3,609,655 A * | 9/1971 | Tymkewicz | H01R 4/34 | 439/733.1 |
| 3,659,247 A * | 4/1972 | Chaney | H01R 25/162 | 174/72 C |
| 3,751,770 A * | 8/1973 | Italiano | A41F 1/00 | 24/697.1 |
| 4,113,333 A * | 9/1978 | Horowitz | H01R 13/436 | 439/103 |
| 6,146,212 A * | 11/2000 | Kipnik | H01R 12/515 | 439/709 |
| 6,254,402 B1 * | 7/2001 | Barnes, Jr. | H01R 13/652 | 439/95 |
| 6,343,961 B1 * | 2/2002 | Sutter | A61B 18/14 | 439/737 |

(Continued)

*Primary Examiner* — Tulsidas C Patel
*Assistant Examiner* — Marcus E Harcum

(57) ABSTRACT

A socket is provided, including: a housing having an accommodating space, a plurality of conductive terminals mounted in the accommodating space, and at least a securing element that secures the conductive terminals with the housing. The conductive terminals are secured by the securing element in a mechanically securing manner with the housing. Therefore, mechanical tools, which are readily attainable, can be used to secure the conductive terminals with the securing element, and the assembly process of the socket can be performed conveniently.

3 Claims, 3 Drawing Sheets

(56) References Cited

U.S. PATENT DOCUMENTS

| | | | | |
|---|---|---|---|---|
| 6,923,663 | B2 * | 8/2005 | Oddsen | H01R 25/006 439/107 |
| 7,041,918 | B1 * | 5/2006 | Wu | H01R 13/703 200/51.09 |
| 8,808,014 | B2 * | 8/2014 | Hsu | H01R 13/41 439/133 |
| 9,039,456 | B2 * | 5/2015 | Wang | H01R 24/76 439/660 |
| 2004/0219823 | A1 * | 11/2004 | Greene | H01R 13/465 439/488 |
| 2011/0086556 | A1 * | 4/2011 | Hollander | H01R 4/4836 439/733.1 |
| 2011/0237138 | A1 * | 9/2011 | Yamada | H01R 13/4226 439/733.1 |
| 2011/0318975 | A1 * | 12/2011 | Giefers | H01R 4/489 439/818 |
| 2014/0364016 | A1 * | 12/2014 | Ozawa | H01R 13/521 439/737 |
| 2015/0255924 | A1 * | 9/2015 | Glick | H01R 13/18 439/733.1 |

* cited by examiner

SOCKET HAVING CONDUCTIVE TERMINALS FOR CONNECTORS

BACKGROUND OF THE INVENTION

1. Field of the Invention

The present invention relates to connectors, and, more particularly, to a socket that is easy to be assembled.

2. Description of Related Art

Many types of sockets are available currently. As shown in FIGS. 1A-1D, a conventional socket 1 in compliance with International Electro technical Commission (IEC) comprises a housing 10 having an accommodating space 100, and a plurality of conductive terminals 11 formed in the accommodating space 100. The housing 10 further comprises a jack 101 coupled to the accommodating space 100, and one end of each of the conductive terminals 11 is exposed from the jack 101.

However, in the conventional socket 1 the conductive terminals 11 are secured inside the housing 10 by a solder bonding method, which is inconvenient and leads to a poor assembly for the socket 1.

Further, the conductive terminals 11 are made of brass, which has a conductivity of around 5-60%, causing the socket 1 to have poor conductivity.

Thus, there is an urgent need for solving the foregoing problems occurring in a conventional socket.

SUMMARY OF THE INVENTION

In view of the foregoing drawbacks of the prior art, the present invention provides a socket, having a plurality of conductive terminals mounted and secured by at least one securing element in the accommodating space of a housing. A chemical securing method is thus replaced with a mechanical securing method, which is more attainable. Therefore, the assembly process of the socket is simplified.

DETAILED DESCRIPTION OF THE PREFERRED EMBODIMENTS

The present invention is described in the following with specific embodiments, so that one skilled in the pertinent art can easily understand other advantages and effects of the present invention from the disclosure of the present invention.

It should be noted that all the drawings are not intended to limit the present invention. Various modification and variations can be made without departing from the spirit of the present invention. Further, terms, such as "one", "top" and etc., are merely for illustrative purpose and should not be construed to limit the scope of the present invention.

Figure 1A:
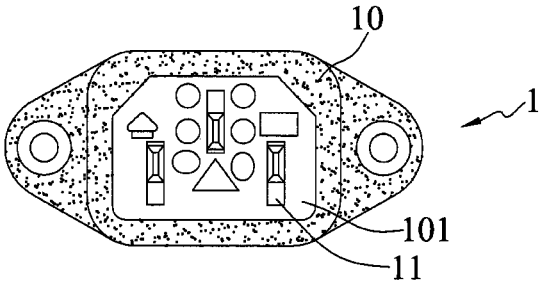
FIG.1A (PRIOR ART)
FIG. 1A is a schematic front view of a conventional socket structure.
Figure 1B:
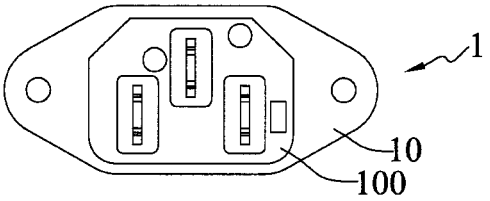
FIG.1B (PRIOR ART)
FIG. 1B is a schematic back view of the socket structure.
Figure 1C:
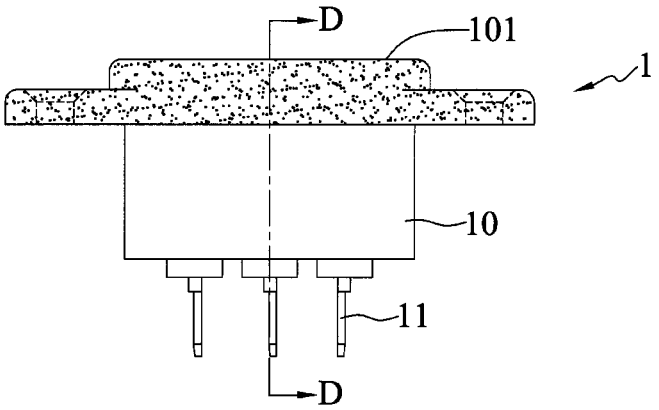
FIG.1C (PRIOR ART)
FIG. 1C is a schematic top view of the socket structure.
Figure 1D:
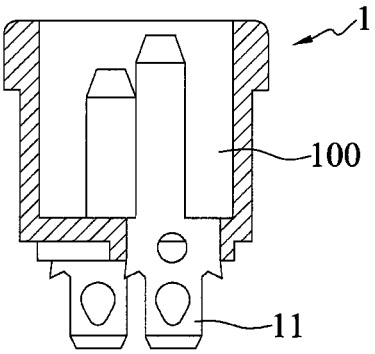
FIG.1D (PRIOR ART)
FIG. 1D is a cross-sectional view of FIG. 1C according to a D-D cross-sectional line.
Figure 2:
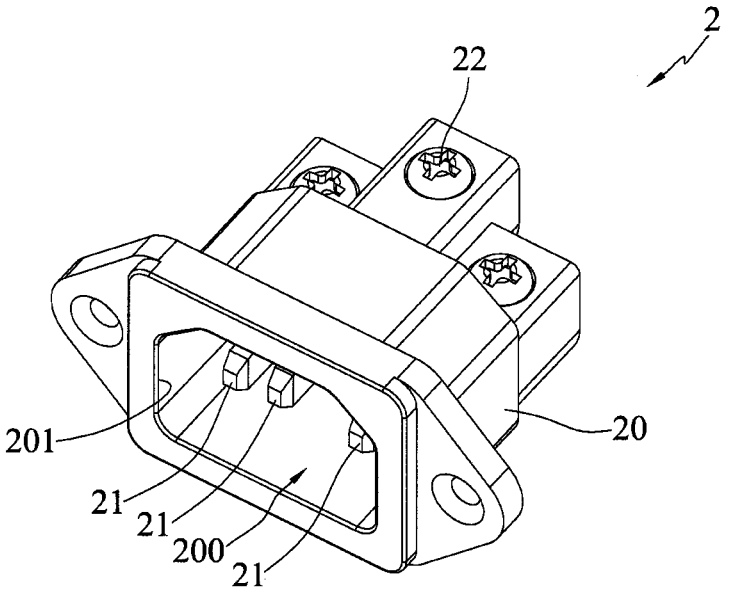
FIG. 2 is a schematic 3D view of a socket according to the present invention.

FIG. 2 shows a socket 2 according to an embodiment of the present invention. The socket 2 comprises: a housing 20 having an accommodating space 200, a plurality of conductive terminals 21 received in the accommodating space 200, and a plurality of securing elements 22 that secure the conductive terminals 21 to the housing 20.

The housing 20 has a jack 201 coupled to the accommodating space 200.

Figure 3:
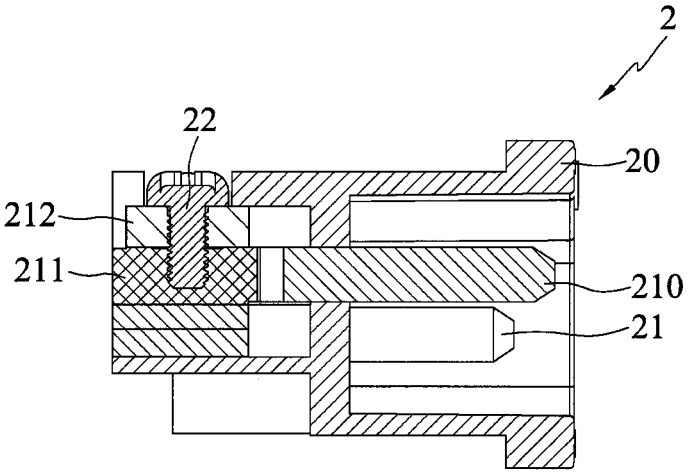
FIG. 3 is a schematic cross-sectional view of a socket according to the present invention.

Each of the conductive terminals 21 has two opposing terminal ends, as shown in FIG. 3, one of which is free from protruding beyond the jack 201 and exposed from the connecting part of the jack 201, and the other of which provides the securing elements 22 to be secured to the securing part 211.

In an embodiment, the securing part 211 is made of a different material than that of the connecting part 210. For instance, the connecting part 210 has a pure copper structure or a brass structure, while the securing part 211 has a stainless steel structure. The pure copper is more preferable for the connecting part 210.

Figure 4A:
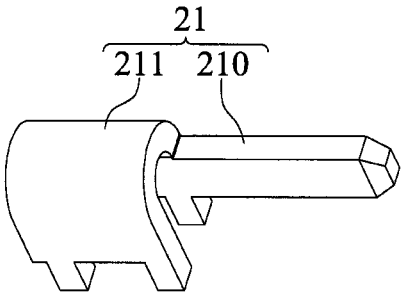
FIGS. 4A-4C are schematic 3D views of conductive terminals of a socket according to another embodiment of the present invention.
Figure 4B:
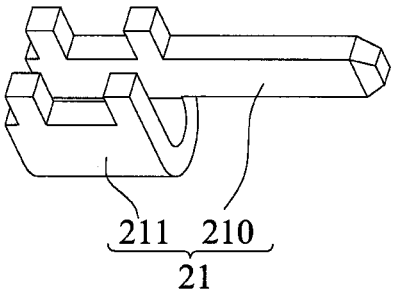
Figure 4C:
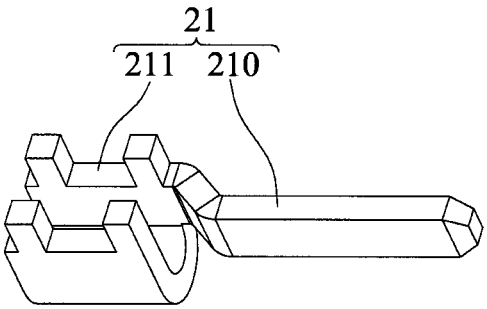

In addition, the conductive terminals 21 can be designed to be in different shapes according to the needs, as shown in FIGS. 4A-4C.

Further, the connecting part 210 of the conductive terminal 21 can be designed to be in different shapes according to the needs, such as sheet-like, needle-like and so on, without any particular limitations.

The securing element 22 is a screw, which penetrates the housing 20 and the securing part 211, so as to secure the conductive terminals 21 inside the housing 20.

The socket 2 according to the present invention is characterized by designing the connecting part 210 to have a pure copper structure, the overall conductivity of the socket 2 is increase, since the conductivity of which (100% for pure copper) is much higher than the conductivity of the conductive terminal of the prior art (made by a brass material with conductivity of around 5-60%).

Further, the assembly of the socket 2 according to the present invention is achieved by a mechanical way of using securing elements 22 (such as using screws), to replace the traditional chemical way (such as solder bonding). Since it is easier to have access of tools used for mechanical securing, the socket 2 of the present invention is easier to be assembled.

In addition, owing to the inadequate hardness of pure copper or brass which may easily cause the screw to slide, causing the securing elements 22 and the conductive terminals 21 to loosen up, the securing part 211 is designed to be made of a different material than the connecting part 210, such that the securing part 211 has an adequate strength to withstand the high torque provided through strongly engaging and securing the securing elements 22 with the conductive terminals 21.

The present invention has been described using exemplary preferred embodiments. However, it is to be understood that the scope of the present invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A socket, comprising: a housing having an accommodating space and a jack coupled to the accommodating space; a plurality of conductive terminals mounted in the accommodating space and free from protruding beyond the jack of the housing, wherein one end of each of the conductive terminals exposed from the jack is needle-like, at least one of the conductive terminals has a stainless steel structure and a connecting part, and the connecting part has a pure copper structure or a brass structure; and at least one securing element that penetrates the housing and is engaged with the stainless steel structure of the conductive terminals to secure the conductive terminals inside the housing, wherein a screwing direction of the securing element is perpendicular to a direction in which the conductive terminals are disposed, and the securing element protrudes and is exposed from the housing.

2. The socket of claim 1, wherein the securing element is a screw.

3. The socket of claim 1, wherein each of the conductive terminals has one end exposed from the jack as the connecting part and the other end as the stainless steel structure for the securing element to be secured therewith.

* * * * *